US006359382B1

(12) United States Patent
Tuttle et al.

(10) Patent No.: US 6,359,382 B1
(45) Date of Patent: Mar. 19, 2002

(54) FLUORESCENT LAMP BASE AND FLUORESCENT LAMP

(75) Inventors: Billy W. Tuttle, Londonderry, NH (US); Joel L. Beyerle, Versailles, KY (US); Dennis B. Shinn, Topsfield, MA (US); Craig S. Boyce, Versailles, KY (US); Donald M. Cannon, Wellsville, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/326,524

(22) Filed: Jun. 4, 1999

Related U.S. Application Data

(60) Provisional application No. 60/120,654, filed on Feb. 19, 1999.

(51) Int. Cl.[7] ..... H01J 1/62; H01J 63/04; H01J 17/18; H01J 61/36; H01J 17/16

(52) U.S. Cl. ..... 313/493; 313/489; 313/635; 313/624; 313/318.02

(58) Field of Search ..... 313/318.02, 318.07, 313/318.01, 624–625, 565, 567, 634, 635, 493, 17–18, 25–27, 36, 39, 489; 445/2

(56) References Cited

U.S. PATENT DOCUMENTS

| | | | | | |
|---|---|---|---|---|---|
| 4,914,345 | A | * | 4/1990 | Suster et al. | 439/615 X |
| 4,918,355 | A | * | 4/1990 | Morris et al. | 313/318.07 |
| 5,229,686 | A | | 7/1993 | Fowler et al. | 313/565 |
| 5,229,687 | A | | 7/1993 | Fowler et al. | 313/565 |
| 5,736,813 | A | | 4/1998 | Foust et al. | 313/490 |
| 5,754,002 | A | | 5/1998 | Haitko et al. | 313/565 |
| 5,998,927 | A | * | 12/1999 | Foust et al. | 313/565 |

OTHER PUBLICATIONS

Federal Register, pp. 26987–26998, vol. 55, No. 126, Jun. 29, 1990.

* cited by examiner

*Primary Examiner*—Ashok Patel
*Assistant Examiner*—Mack Haynes
(74) *Attorney, Agent, or Firm*—Carlo S. Bessone

(57) ABSTRACT

A lamp base, and mercury vapor discharge lamp including such lamp base, is provided which is fabricated from a material which substantially prevents the formation of leachable mercury in lamp disposal and testing procedures.

18 Claims, 1 Drawing Sheet

FLUORESCENT LAMP BASE AND FLUORESCENT LAMP

CROSS-REFERENCE TO RELATED APPLICATION

This application claims the benefit of U.S. Provisional Application No. 60/120,654, filed Feb. 19, 1999

TECHNICAL FIELD

The present invention relates to a lamp base for use with a fluorescent lamp and a fluorescent lamp which comprises such lamp base, and in particular to a lamp base which reduces soluble mercury in a lamp to an acceptable level.

BACKGROUND ART

Fluorescent lamps contain elemental mercury. During lamp operation, chemical reactions take place that convert some of the elemental mercury to salts or compounds such as mercuric oxide (HgO) that are water soluble. There is a growing concern that a waste stream resulting from the disposal of fluorescent lamps may leach excessive amounts of this soluble form of mercury (Hg). The method of measuring the amount of soluble mercury which may leach from the waste stream resulting from the disposal of fluorescent lamps is described in the Toxicity Characteristic Leaching Procedure (TCLP) prescribed on pages 26987–26998 of volume 55, number 126 of the Jun. 29, 1990 issue of the Federal Register. At the present time, the United States Environmental Protection Agency (EPA) defines a maximum concentration level for mercury at 0.2 milligram leachable mercury per liter leachate fluid when the TCLP is applied. According to the present standards, a fluorescent lamp is considered nonhazardous when less than 0.2 milligram per liter of leachable mercury results using the TCLP. In addition to leaching Hg into the waste streams, disposal operators charge a fee for disposal of lamps that are not within the EPA's limits. Therefore, customers must pay to dispose of these lamps. Customers of fluorescent lamps generally do not desire to have to contend with the EPA and disposal concern regarding mercury levels, and therefore some customers specify only those lamps which pass the TCLP standard.

Heretofore, efforts have been made to reduce the leaching of soluble mercury during the TCLP as well as in landfills. Various methods have been proposed which attempt to treat or process burned-out discharge lamps or scrap lamp exhaust tubing containing mercury in order to reclaim the mercury and thereby reduce the amount of mercury-contaminated scrap. These methods are summarized as background in U.S. Pat. Nos. 5,229,686 and 5,229,687 which were granted to Fowler et al. on Jul. 20, 1993. These two patents are commonly owned with the instant application (GTE Products Corporation having changed its name to Osram Sylvania Inc.), and are incorporated herein by reference. These patents describe methods by which to render a mercury vapor lamp nonleaching upon disposal without the use of expensive treatment processes to reclaim the mercury. The method of the U.S. Pat. No. 5,229,686 patent employs a chemical agent, enclosed within the lamp, suitable for chemically combining a substantial portion of the soluble mercury as a sparingly soluble salt when the lamp is pulverized during disposal. The method of the U.S. Pat. No. 5,229,687 patent employs a chemical agent, enclosed within the lamp, suitable for electro-chemically reducing a substantial portion of the soluble mercury to elemental mercury, when the lamp is pulverized during disposal. Preferably, this chemical agent is an element which has an electrode potential for oxidation reactions higher than mercury but which is not sufficiently active to displace hydrogen from acidic aqueous solutions. In one embodiment, the chemical agent is sealed within an enclosure (e.g., glass) which is rupturable upon pulverization of the lamp. In another embodiment, the chemical agent is mixed with the basing cement used to secure the lamp bases to the glass envelope. The chemical agent acts to reduce soluble mercury produced during lamp operation to elemental mercury that is not leachable as measured by the TCLP.

The chemical agent used in the U.S. Pat. No. 5,279,687 patent may be used in various forms, e.g., as a powder, dust, wire mesh, or metallic foil. The amount or size of the chemical agent is directly related to its surface area and surface condition, finely divided metallic powders being preferred over a solid mass because of their relatively large effective surface areas. Because of their availability and inexpensive cost, iron and copper, in the form of a powder or dust, are preferred. The amount of chemical agent present should be sufficient to electrochemically reduce the amount of soluble mercury within the lamp, which is leached at the time of disposal, to less than 0.2 milligram per liter of an aqueous acid solution such as a sodium acetate buffer solution as prescribed in the TCLP.

Although the methods described in the U.S. Pat. Nos. 5,229,686 and 5,229,687 patents provide generally satisfactory performance, they have been found to have certain disadvantages. For example, in considering the U.S. Pat. No. 5,229,686 patent, in some fluorescent lamp applications the quantity of chemical agent required to chemically combine nearly all of the mercury within the lamp may be so large as to be inconvenient or impossible to contain within a standard lamp envelope. In considering the U.S. Pat. No. 5,229,687 patent, in some fluorescent lamp applications the metallic copper or iron reduces the amount of leachable mercury via a surface reduction-oxidation reaction between adsorbed mercury ions and zero-valent metal atoms. In order for this reaction to occur, the dissolved ionic mercury must first find its way to and become adsorbed upon the metal surface. Thus, the effectiveness of a metallic element as a means of reducing leachable mercury is limited by the rates at which mercury ions diffuse to the metal surface and become adsorbed thereon. Increasing the surface area of the metallic elements described in the U.S. Pat. No. 5,229,687 patent to improve the chance of contact between dissolved mercury ions and a metal surface followed by the adsorption of the mercury upon that surface is not a feasible alternative. For example, it may be difficult or impossible to incorporate a sufficiently large quantity of a high surface area agent such as finely divided metal within a fluorescent lamp, the more so the smaller or more compact the lamp. In a small lamp, the only convenient way to introduce the metal may be as a component of the basing cement. However, the electrical conductivity of the metal may prevent its incorporation into the basing cement since the cement may easily come into contact with internal electrical leads. Although electrically insulating materials might be added to the basing cement in addition to or in place of the normal $CaCO_3$ cement filler without risk of creating electrical short circuits within the lamp, such an addition adds to the cost.

In U.S. Pat. No. 5,736,813, which was granted to Foust et al. on Apr. 7, 1998, it is stated that the formation of leachable mercury during TCLP testing or during disposal of mercury vapor discharge lamps may be substantially prevented by incorporating a pH control agent in the lamp structure or in the test solution to provide a pH of about 5.5 to 6.5. A low pressure mercury discharge lamp is described which includes about 5–15 grams of a pH control agent (generally a water-soluble base) which, it is suggested, is sufficient to substantially prevent formation of ferric and cupric compounds which oxidize elemental mercury to a soluble form. The primary disadvantage of this method of reducing mercury leaching is that it may be difficult or, depending upon the lamp type, practically impossible to package the relatively large amounts of the required pH control agent (5–15 grams) within the structure of a typical mercury vapor lamp.

U.S. Pat. No. 5,754,002, which was granted to Haitot et al. on May 19, 1998, relates to substantially preventing the formation of leachable mercury during disposal or TCLP testing of mercury vapor discharge lamps by incorporating an antioxidant in the lamp structure or in a test solution. A mercury discharge lamp is described which includes an effective amount, 0.05 to 10 grams per lamp, of an antioxidant such as ascorbic acid, sodium ascorbate, ferrous sulfate, ferrous gluconate and others. The stated purpose is to prevent the formation of soluble mercury compounds from elemental mercury in a landfill or in the TCLP test. The antioxidant is incorporated into the base end cap cavity, either in a base cement, or in an inert water soluble binder. The method described in the U.S. Pat. No. 5,754,002 patent adds cost and a component that has no other function than to pass the TCLP test. Furthermore, the stated purpose of preventing formation of water soluble mercury from elemental mercury does not address the water soluble mercury compounds formed during lamp operation. In this regard, the described ferrous salt is relatively ineffective in reducing soluble mercury concentration to less than 0.2 parts per million.

Some commercially available fluorescent lamps meet the requirements of the TCLP. Among these are, for example, linear four-foot lamps that utilize iron shields around the electrodes and contain three to five milligrams of mercury. The combination of the iron (low carbon steel) shields and soluble mercury content of less than five milligrams enables the lamps to meet the requirements. However, such an approach is unsuitable with significantly larger amounts of up to ten milligrams or more of soluble mercury. It is known that elemental mercury in lamps is converted to soluble mercury compounds during the lamps's operating life. For at least a fraction of typical commercial lamps, the conversion significantly exceeds three to five milligrams of mercury. The failure of lamps before rated lifetime is unacceptable, and therefore a mercury dose significantly greater than three to five milligrams is desirable. An additional disadvantage of lamps with iron cathode shields is that the incorporation of the shield and the capsule for dosing mercury adds significant complexity and expense to the manufacture of the lamp.

All of the foregoing attempts to reduce the leaching of soluble mercury during the TCLP test and disposal involve the addition of significant complexity to the manufacture of fluorescent lamps and therefor added cost. In addition, many of such attempts do not employ standard lamp components. To the contrary, components are added solely to enable passing of the TCLP test. Further, some attempts require a low practical limit on the mercury content of the lamp, and such lamps may not pass the TCLP test unless the mercury content is very low or the component added to solve the problem is too massive to be practical.

In addition to all of the foregoing, conventional fluorescent lamp bases are typically fabricated from aluminum or brass. Such bases do not satisfactorily reduce leaching of soluble mercury. In addition, aluminum bases have a tendency to deform during transportation and during the base and lamp manufacturing process. Deformed bases result in manufacturing losses and therefore added costs.

DISCLOSURE OF THE INVENTION

It is an object of the present invention to provide an improved lamp base.

It is another object of the present invention to provide a lamp base which aids in the conversion of soluble mercury to elemental mercury.

A further object of the present invention is to provide a lamp base having improved resistance to deformation during transportation and during base and lamp manufacturing.

Another object of the present invention is to provide an improved lamp having the lamp base(s) of the present invention.

Yet another object of the present invention is to provide a lamp having a lamp base which aids in the conversion of soluble mercury to elemental mercury during disposal of the lamp.

A further object of the present invention is to provide a lamp having a lamp base which aids in the conversion of soluble mercury to elemental mercury and is less costly to fabricate than lamps heretofore provided.

Another object of the present invention is to provide a lamp which aids in the conversion of soluble mercury to elemental mercury yet requires only a standard lamp component.

It is a further object of the present invention is to provide an improved lamp which permits the use of practical amounts of mercury and passes the TCLP using only a standard lamp component.

Yet another object of the present invention is to provide a low cost fluorescent lamp base that effects the reduction of soluble mercury to elemental mercury in tests, such as the TCLP, and in lamp disposal operations.

A further object of the present invention is to provide an improved lamp base which can reduce at least 10 mg of soluble mercury in otherwise conventional four foot T8 and T12 lamps to less than 0.2 milligrams per liter in the TCLP.

This invention achieves these and other objects by providing a lamp base which is fabricated from a material which substantially prevents formation of leachable mercury in lamp disposal and testing procedures. A mercury vapor discharge lamp is also provided. Such lamp comprises an envelope of light transmitting vitreous material. The envelope contains an inert starting gas and a quantity of elemental mercury, and electrodes sealed in the envelope for establishing an arc discharge. The electrodes are electrically connected to respective lamp connectors. At least one lamp base is provided which is fabricated from a material to substantially prevent formation of leachable mercury in lamp disposal and testing procedures. In a preferred embodiment the lamp base of the present invention is fabricated from steel, and in particular, low carbon steel.

BRIEF DESCRIPTION OF THE DRAWINGS

This invention may be clearly understood by reference to the attached drawings in which like reference numerals designate like elements an in which.

MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
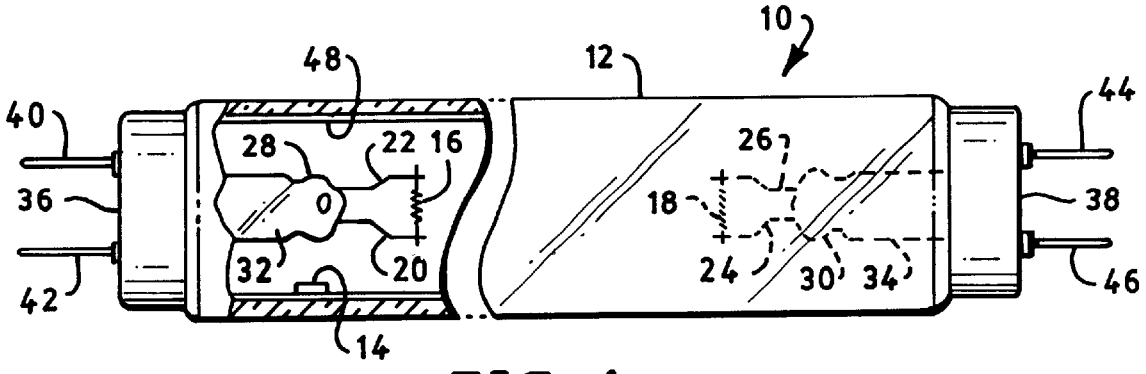
FIG. 1 is a perspective view partially broken away of a mercury vapor discharge lamp constructed in accordance with one embodiment of the present invention.

The embodiment of this invention which is illustrated in FIG. 1 is particularly suited for achieving the objects of this invention. The drawing illustrates a mercury vapor discharge lamp 10, such as a fluorescent lamp, comprising an elongated sealed envelope 12 of light-transmitting vitreous material. Envelope 12 if filled with an inert gas such as argon at a low pressure, for example two torr, and a quantity of mercury 14, at least enough to provide a low vapor pressure of about six microns during operation. An electrode 16 and 18 is disposed at each end of envelope 12 supported by lead-in wires 20, 22 and 24, 26 respectively. Electrodes 16 and 18 are coated with electron-emitting materials such as BaO—SrO—CaO containing $ZrO_3$. The lead-in wires extend through stem presses 28, 30 in mount stems 32, 34 to the contacts in lamp bases 36 and 38 secured to the ends of envelope 12. The electrodes 16 and 18 are electrically connected to respective lamp connectors 40, 42 and 44, 46 through respective contacts and lead-in wires in a conventional manner.

A phosphor coating 48 is disposed on the interior surface of envelope 12. Phosphor coating 48, which may be a halophosphate phosphor such as Cool White, is responsive to the ultraviolet radiation generated by the arc discharge established between electrodes 16, 18 to provide a desired emission spectrum.

Metal lamp bases are standard parts of a fluorescent lamp and are typically fabricated from aluminum or brass. Mercury compounds in fluorescent lamps are generally soluble in the aqueous acid present in the TCLP and in landfill disposal operations. Aluminum and brass do not satisfactorily aid in the conversion of such soluble mercury to elemental mercury. In the present invention, the lamp bases, such as lamp bases 36 and 38, are fabricated from a material that does aid in the conversion of such soluble mercury to elemental mercury. In this manner, the lamp base material will substantially prevent formation of leachable mercury in lamp testing procedures, such as the TCLP, and in lamp disposal, thereby making the lamps safe for disposal at the end of lamp life.

The lamp base of the present invention may be fabricated from any metal, including alloys, provided it satisfactorily prevents formation of leachable mercury in testing procedures and meets lamp disposal requirements. For example, the lamp base of the present invention may be fabricated from iron or tin. In another example, the lamp base may comprise a brass base which has been tin plated or an iron base having aluminum cladding.

In a preferred embodiment, lamp bases 36 and 38 are fabricated from steel, such as low carbon steel. Low carbon steel has the ability to reduce soluble mercury to elemental mercury and thereby substantially prevent fabrication of leachable mercury in lamp disposal and testing procedures. By providing a lamp base fabricated from such material, mercury vapor discharge lamps may be provided which satisfy TCLP standards and provide safe lamp disposal using a low-cost standard metal lamp component. These objectives are accomplished without undesirable limitations on the level of mercury used. For example, four-foot fluorescent lamps having lamp bases fabricated from low carbon steel permits the usage of levels of mercury up to and over ten milligrams. An added benefit using low carbon steel lamp bases is that they will be more resistant to deformation during the manufacturing and the transportation of bases and lamps than the conventional aluminum lamp bases of similar thickness.

Figure 2:
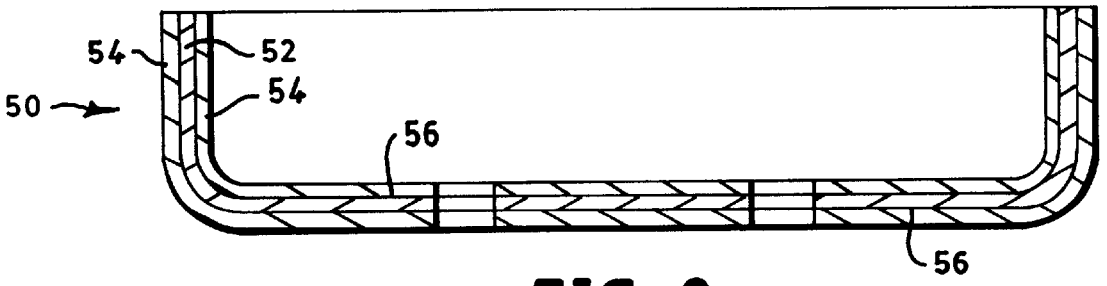
FIG. 2 is a sectional view of a lamp base constructed in accordance with another embodiment of the present invention.

In the embodiment illustrated in FIG. 2, a lamp base 50 is provided which comprises a base portion 52 fabricated from a material which substantially prevents formation of leachable mercury in lamp disposal and testing procedures and a protective portion 54. The protective portion 54 covers an outer surface 56 of the base portion 52 and serves to protect the base portion from, for example, oxidative corrosion. Examples of materials from which the protective portion such as protective portion 54 may be fabricated include, without limitation, zinc, tin, nickel and chromium.

Lamp base 50 may replace lamp bases 36 and 38 of the mercury vapor discharge lamp of FIG. 1, and such a modified lamp will be otherwise identical to the lamp 10.

In a preferred embodiment the base portion 52 may be fabricated from low carbon steel and the protective portion 54 may be a zinc layer. Without limitation, the zinc layer may be applied by coating or plating the base portion with zinc. For example, a conventional electroplating operation may be used. Plating the low carbon steel portion 52 with the zinc layer 54 prevents oxidative corrosion of the low carbon steel. Zinc-nickel alloy plate has an even greater corrosion resistance than pure zinc.

In some embodiments, the protective portion will be a material which will not reduce soluble mercury in the lamp to an acceptable level under acidic conditions. In such embodiments, in addition to protecting the base portion during normal lamp life, the material of the protective portion should readily dissolve during lamp disposal under acidic conditions so that the base portion may be sufficiently exposed to reduce the soluble mercury in the lamp to an acceptable level. One way of achieving this objective is to control the thickness of the protective portion. For example, in a preferred embodiment, the base portion 52 is low carbon steel and the protective portion 54 is a layer of zinc provided by zinc plating. Since zinc is not an effective agent to reduce soluble mercury, the effectiveness of zinc-plated steel in the reduction of soluble mercury will depend upon the solubility of the zinc-plate in the weakly acidic solution present in the TCLP or in a landfill. In other words, dissolution of the zinc-plate will be required in order to expose the iron substrate and thereby achieve adequate reduction of the soluble mercury. Complete dissolution of the zinc plating depends upon the thickness of the plating and the degree of surface passivation of the plating. Table 1, described hereinafter, illustrates a number of zinc-plated steels which satisfy the TCLP requirement for lamps containing as much as 10 mg of soluble mercury. When zinc is the protective portion of the lamp, such as protective portion 54, the zinc layer should be relatively thin, preferably between about 2 $\mu$m and about 10 $\mu$m in mean thickness.

Since it has been found that tin has the ability to reduce soluble mercury in the lamp to an acceptable level, when the protective portion 54 is tin there is no need for the tin layer to readily dissolve during lamp disposal under acidic conditions.

The present invention is not limited to providing a protective portion by coating or plating the base portion. Rather, when a protective portion is to be provided, the completed lamp base should be protected from corrosion during lamp life and be capable of reducing the soluble mercury in the lamp to an acceptable level during testing and disposal. Examples of lamp bases which may be fabricated to meet these dual objectives, in addition to lamp bases having coated or plated base portions, include, without limitation, lamp bases fabricated as laminates, lamp bases provided in the form of a structure which includes a sandwich of metal sheets and/or wire mesh and/or other metal forms, lamp bases provided using cladding, and the like.

Figure 3:
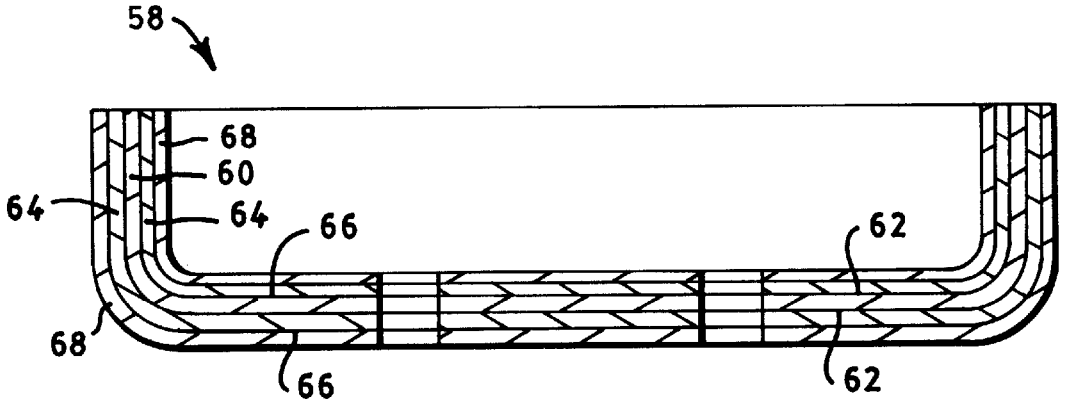
FIG. 3 is a sectional view of a lamp base constructed in accordance with another embodiment of the present invention.

The embodiment illustrated in FIG. 3 is identical to FIG. 2 with the exception that an additional protective layer is provided. In particular, a lamp base 58 includes a base portion 60 having an outer surface 62 covered with a first protective portion 64. First protective portion 64 has an outer surface 66 covered with a second protective portion 68. Without limitation, in the embodiment illustrated in FIG. 3, the base portion 60 and first protective portion 64 are identical to the base portions 52 and portion 54, respectively, illustrated in FIG. 2. The protective portion 68 may be provided to prevent corrosion of the protective portion 64. For example, in a preferred embodiment, the base portion 60 is fabricated from low carbon steel which is zinc plated to form the protective portion 64. Zinc has a tendency to corrode thereby forming an unsightly lamp base. To prevent this from happening, the zinc plating 64 is treated with a chromate protective coating 68. Examples include clear chromate and the more protective yellow chromate and leached yellow chromate. Yellow chromate coating is particularly useful in harsh environments to prevent such unsightly corrosion of the zinc plating. Yellow chromate coating greatly increases the time to white corrosion and to rust versus clear chromate coating.

Rather than providing a second protective portion, the first protective portion may be a zinc alloy. For example, in the embodiment illustrated in FIG. 2, the protective portion 54 may be a zinc alloy such as Zn—Ni, Zn—Cr or Zn—Fe. Such a material will provide the necessary protection so that the base portion 52 does not corrode, the nature of the alloy-type protective layer being such as to be resistant to corrosion.

An understanding of the present invention is facilitated by reference to conventional four foot T8 and T12 fluorescent lamps having aluminum or brass bases and as many as two iron foil or sheet-type cathode shields having a total surface area of about 8 $cm^2$ (T8 lamps) and 14 $cm^2$ (T12 lamps). In such lamps, the iron shields will serve as the agent for reducing soluble mercury to elemental mercury. Although such lamps will meet TCLP and disposal requirements in lamps having 5 mg of soluble mercury, they will not meet such requirements in lamps having 10 mg of soluble mercury. It has been observed by applicants that increasing the surface area of the iron foil or sheet in such lamps to 12 $cm^2$ (T8 lamps) and 18 $cm^2$ (T12 lamps) will reduce about 10 mg of soluble mercury to less than 0.2 milligrams per liter in the TCLP. However, such lamps are not feasible.

Table 1 illustrates examples of specific lamp bases which were subjected to the TCLP in a conventional manner and which were observed to reduce at least 10 mg of soluble mercury to less than 0.2 milligrams per liter in typical four-foot T8 and T12 fluorescent lamps manufactured by Osram Sylvania Inc. Accordingly, such lamps satisfy TCLP and lamp disposal requirements. Each lamp base illustrated in Table 1 includes a lamp portion fabricated from low carbon steel and a zinc-plated or tin-plated first protective portion. In addition, all of the zinc-plated bases have a second chromate protective portion.

TABLE 1

Metal Concentrations in TCLP Leachate from Four-Foot Fluorescent Lamps with Added HgO and Zinc-Plated or Tin-Plated Steel Bases Substituted for Aluminum Bases

| Lamp Type | Metal Description* | Metal Thickness (mm) | Plating Depth ($\mu$m) | Surface Area of Metal ($cm^2$) | Added HgO as mg Hg | TCLP Hg mg/l | TCLP Fe mg/l | TCLP Zn mg/l |
|---|---|---|---|---|---|---|---|---|
| T8 | Aluminum Control | 0.25 | — | ~24 | 10 | 1.20 | — | — |
| T12 | Aluminum Control | 0.25 | — | ~37 | 10 | 0.80 | — | — |
| T8 | CC Zn-Plated Base | 0.25 | ~7 | ~24 | 5 | 0.15 | 43 | 62 |
| | | | | | 10 | 0.15 | 42 | 63 |
| T12 | CC Zn-Plated Base | 0.25 | ~7 | ~37 | 5 | 0.11 | 91 | 62 |
| | | | | | 10 | 0.16 | 89 | 59 |
| | | | | | 15 | 0.18 | 85 | 60 |
| T8 | YC Zn-Plated Base | 0.25 | ~7 | ~22 | 5 | 0.11 | 54 | 58 |
| | | | | | 10 | 0.16 | 44 | 61 |
| T12 | YC Zn-Plated Base | 0.25 | ~7 | ~37 | 10 | 0.14 | 80 | 60 |
| | | | | | 15 | 0.19 | 76 | 58 |
| T8 | LYC Zn-Plated Base | 0.25 | ~7 | ~24 | 5 | 0.07 | 55 | 57 |
| | | | | | 10 | 0.16 | 47 | 55 |
| T12 | LYC Zn-Plated Base | 0.25 | ~7 | ~37 | 10 | 0.16 | 83 | 57 |
| | | | | | 15 | 0.19 | 73 | 52 |
| T8 | CC Zn-Plated Base | 0.25 | ~4 | ~24 | 5 | 0.11 | 76 | 36 |
| | | | | | 10 | 0.14 | 65 | 41 |
| T12 | CC Zn-Plated Base | 0.25 | ~4 | ~37 | 10 | 0.16 | 95 | 31 |
| | | | | | 15 | 0.19 | 101 | 30 |
| T8 | LYC Zn-Plated Base | 0.25 | ~4 | ~24 | 5 | 0.11 | 53 | 36 |
| | | | | | 10 | 0.15** | 64** | 37** |
| T12 | LYC Zn-Plated Base | 0.25 | ~4 | ~37 | 10 | 0.15 | 99 | 32 |
| | | | | | 15 | 0.19 | 94 | 32 |
| | | | | | 10 | 0.15** | 91** | 31** |
| T8 | CC Zn- | 0.25 | ~2 | ~24 | 5 | 0.10 | 80 | 20 |

TABLE 1-continued

Metal Concentrations in TCLP Leachate from Four-Foot Fluorescent Lamps with Added HgO and Zinc-Plated or Tin-Plated Steel Bases Substituted for Aluminum Bases

| Lamp Type | Metal Description* | Metal Thickness (mm) | Plating Depth ($\mu$m) | Surface Area of Metal ($cm^2$) | Added HgO as mg Hg | TCLP Hg mg/l | TCLP Fe mg/l | TCLP Zn mg/l |
|---|---|---|---|---|---|---|---|---|
| | Plated Base | | | | 10 | 0.10 | 74 | 24 |
| T12 | CC Zn- | 0.25 | ~2 | ~37 | 10 | 0.16 | 120 | 20 |
| | Plated Base | | | | 15 | 0.15 | 103 | 17 |
| T8 | CC Zn- | 0.125 | ~2 | ~24 | 5 | 0.11 | 97 | 22 |
| | Plated Base | | | | | 0.10 | 78 | 23 |
| | | | | | | 0.11 | 70 | 26 |
| | | | | | 10 | 0.12 | 79 | 20 |
| | | | | | | 0.15 | 79 | 19 |
| T12 | CC Zn- | 0.125 | ~2 | ~37 | 10 | 0.13 | 108 | 18 |
| | Plated | | | | 15 | 0.14 | 100 | 18 |
| T12 | Tin- | 0.25 | ~25 | ~37 | 5 | 0.06 | 52 | 0.8 |
| | Plated | | | | 10 | 0.19 | 57 | 0.9 |

*Bases have: CC = Clear Chromate, YC = Yellow Chromate, or LYC = Leached Yellow Chromate outer protective coating
**Bases heated at 200° C. prior to test Without limitation, it is clear from Table 1 that steel lamp bases having the features described therein including a surface area of about 24 $cm^2$ (T8 lamps) and 37 $cm^2$ (T12 lamps) and a plating depth of about 2 $\mu$m to about 7 $\mu$m act as an agent for reducing soluble mercury to elemental mercury with respect to respective T8 and T12 lamps to meet TCLP and disposal requirements. Without being bound by a theory of operation, it is believed that a satisfactory amount of mercury is reduced as illustrated in Table 1 due to the relatively larger surface area of the lamp bases, such lamp bases serving as the reducing agent. Lamp bases providing more or less surface area are also within the scope of the present invention provided they substantially prevent formation of leachable mercury in lamp disposal and testing procedures.

In considering the present invention, a low cost fluorescent lamp may be provided which may be dosed with a relatively high or low amount of mercury measured by industry standards, and such lamp will substantially prevent formation of leachable mercury in lamp disposal and testing procedures with the aid of only a standard lamp component; that is, the lamp base(s). For example, T8 and T12 fluorescent lamps having lamp bases fabricated from low carbon steel will meet these objectives. In particular, use of low carbon steel lamp bases will reduce 10 mg of soluble mercury to less than 0.2 mg/l and will therefore provide fluorescent lamps which pass the TCLP test and can be safely disposed of at the end of lamp life. In addition, low carbon steel is lower cost than other alternative base materials and is relatively inexpensive to implement in the manufacturing process, requiring a low investment in capital equipment. Decreased material shrinkage will also be a cost saving. The use of low carbon steel provides the added benefit of having an elastic modulus about three times that of aluminum, and therefore bases fabricated from low carbon steel are less likely to deform during production processing and transportation of the bases. Although low carbon steel tends to corrode and rust in most environments, this may be avoided using a protective coating or plating of, for example,zinc, tin, nickel or chromium. All of these materials provide a coating that will protect the steel from direct exposure to the environment and therefore from rusting. Zinc plating provides a particularly effective protective layer. For example, if the other coatings are broken so as to expose the steel, the steel will corrode or rust. However, if the base is zinc-plated steel, and the coating is broken, the zinc acts as a sacrificial anode and is corroded or oxidized preferentially to the steel until the zinc is consumed. Zinc plating is a bright material and therefore also provides an attractive lamp base. Corrosion of the zinc may be prevented by treating the zinc plating with chromate.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A lamp base comprising a base portion fabricated from a material which substantially prevents formation of leachable mercury in lamp disposal and testing procedures, a first protective portion covering an outer surface of said base portion, and a second protective portion covering an outer surface of said first protective portion.

2. The lamp base of claim 1 wherein said material is steel.

3. The lamp base of claim 1 wherein said first protective portion is zinc.

4. The lamp base of claim 3 wherein said first protective portion is a zinc plated layer.

5. The lamp base of claim 3 wherein said zinc plated layer is between about 2 $\mu$m and about 10 $\mu$m in mean thickness.

6. The lamp base of claim 3 wherein said second protective portion being chromate.

7. The lamp base of claim 1 wherein said first protective portion is a zinc alloy.

8. The lamp base of claim 1 wherein said first protective portion is a metal selected from the group consisting of tin, nickel and chromium.

9. The lamp base of claim 1 wherein said material is aluminum clad iron.

10. In a mercury vapor discharge lamp having an envelope of light-transmitting vitreous material, said envelope containing therein an inert starting gas and a quantity of elemental mercury, electrodes sealed in said envelope for establishing an arc discharge, said electrodes being electrically connected to respective lamp connectors, and at least one lamp base, wherein the improvement comprises said at least one lamp base comprising a base portion fabricated from a material which substantially prevents formation of leachable mercury in lamp disposal and testing procedures, a first protective portion covering an outer surface of said base portion, and a second protective portion covering an outer surface of said first protective portion.

11. The mercury vapor discharge lamp of claim 10 wherein said material is steel.

12. The mercury vapor discharge lamp of claim 10 wherein said first protective portion is zinc.

13. The mercury vapor discharge lamp of claim 12 wherein said first protective portion is a zinc plated layer.

14. The mercury vapor discharge lamp of claim 12 wherein said zinc plated layer is between about 2 $\mu$m and about 10 $\mu$m in mean thickness.

15. The mercury vapor discharge lamp of claim 12 wherein said second protective portion being chromate.

16. The mercury vapor discharge lamp of claim 10 wherein said first protective portion is a zinc alloy.

17. The mercury vapor discharge lamp of claim 10 wherein said first protective portion is a metal selected from the group consisting of tin, nickel and chromium.

18. The mercury vapor discharge lamp of claim 10 wherein said material is aluminum clad iron.

* * * * *